US010192724B2

(12) United States Patent
Umemura

(10) Patent No.: US 10,192,724 B2
(45) Date of Patent: Jan. 29, 2019

(54) MS/MS MASS SPECTROMETRIC METHOD AND MS/MS MASS SPECTROMETER

(71) Applicant: SHIMADZU CORPORATION, Kyoto-shi, Kyoto (JP)

(72) Inventor: Yoshikatsu Umemura, Mishima-gun (JP)

(73) Assignee: SHIMADZU CORPORATION, Kyoto-shi, Kyoto (JP)

( * ) Notice: Subject to any disclaimer, the term of this patent is extended or adjusted under 35 U.S.C. 154(b) by 75 days.

(21) Appl. No.: 15/318,899

(22) PCT Filed: Jun. 16, 2014

(86) PCT No.: PCT/JP2014/065905

§ 371 (c)(1),
(2) Date: Dec. 14, 2016

(87) PCT Pub. No.: WO2015/193946

PCT Pub. Date: Dec. 23, 2015

(65) Prior Publication Data

US 2017/0140909 A1 May 18, 2017

(51) Int. Cl.
*H01J 49/00* (2006.01)
*H01J 49/42* (2006.01)

(52) U.S. Cl.
CPC ..... *H01J 49/0054* (2013.01); *H01J 49/0031* (2013.01); *H01J 49/0036* (2013.01); *H01J 49/0045* (2013.01); *H01J 49/4215* (2013.01)

(58) Field of Classification Search
CPC . H01J 49/0036; H01J 49/0054; H01J 49/4215
(Continued)

(56) References Cited

U.S. PATENT DOCUMENTS 8,269,166 B2 * 9/2012 Okumura ..... H01J 49/0045 250/281
8,748,811 B2 * 6/2014 Okumura ..... H01J 49/0009 250/281

(Continued)

FOREIGN PATENT DOCUMENTS

WO 2010/089798 A1 8/2010

OTHER PUBLICATIONS

International Search Report of PCT/JP2014/065905, dated Aug. 12, 2014. [PCT/ISA/210].

(Continued)

*Primary Examiner* — John H Le
(74) *Attorney, Agent, or Firm* — Sughrue Mion, PLLC

(57) ABSTRACT

When, in performing MS/MS analysis on a multivalent ion originated from a target component, an analyzing operator inputs at least two values of a mass value $m_{Loss}$ of an eliminated fragment, a valence $z_{Loss}$ of the eliminated fragment, a valence $z_{Prec}$ of a precursor ion and a valence $z_{Prod}$ of a product ion by an inputting unit, a valence calculating unit calculates an uninput valence $z_{Prec}$ or $z_{Prod}$ based on the relation, $z_{Prec}=z_{Prod}+z_{Loss}$. Upon the start of the MS/MS analysis, a precursor ion m/z setting unit sets $m/z=M_{Prec}$ of an ion that passes through a front-stage quadrupole mass filter , and a passed product ion m/z calculating unit calculates $m/z=M_{Prod}$ of the product ion that passes through a rear-stage quadrupole mass filter by applying $M_{Prec}$, $m_{Loss}$, $z_{Prec}$ and $z_{Prod}$ above to the relational expression, $M_{Prod}=(M_{Prec}\times z_{Prec}-m_{Loss})/z_{Prod}$.

15 Claims, 2 Drawing Sheets

(58) Field of Classification Search
USPC ..... 702/27; 250/281, 288
See application file for complete search history.

(56) References Cited

U.S. PATENT DOCUMENTS 8,866,074 B2 * 10/2014 Okumura ..... H01J 49/0031
250/281
9,075,073 B1 * 7/2015 Sakamoto ..... H01J 49/26

OTHER PUBLICATIONS

Louris et al., "New Scan Modes Accessed with a Hybrid Mass Spectrometer", Analytical Chemistry, vol. 57, No. 14, Dec. 1985, pp. 2918-2924. (7 pages total).
Schwartz et al., "Systematic Delineation of Scan Modes in Multi-dimensional Mass Spectrometry", vol. 62, No. 17, Sep. 1, 1990, pp. 1809-1818. (10 pages total).
Communication dated Jun. 21, 2017 from the European Patent Office in counterpart application No. 14895479.5.
Written Opinion for PCT/JP2014/065905 dated Aug. 12, 2014. [PCT/ISA/237].

* cited by examiner

MS/MS MASS SPECTROMETRIC METHOD AND MS/MS MASS SPECTROMETER

CROSS REFERENCE TO RELATED APPLICATIONS

This application is a National Stage of International Application No. PCT/JP2014/065905 filed Jun. 16, 2014, the contents of all of which are incorporated herein by reference in their entirety.

TECHNICAL FIELD

The present invention relates to an MS/MS mass spectrometric method and an MS/MS mass spectrometer for selecting a specific ion species to be analyzed, and after that, mass-analyzing a product ion generated through its dissociation, and more specifically, relates to an MS/MS mass spectrometer and an analyzing method using the MS/MS mass spectrometer capable of interlinkingly scanning a mass-to-charge ratio of a precursor ion to be dissociated and a mass-to-charge ratio of a product ion to be analyzed.

BACKGROUND ART

In order to identify a substance with a large molecular weight and analyze its structure, one of known techniques of mass spectrometry is MS/MS analysis (also called tandem analysis). A typical MS/MS mass spectrometer is a triple quadrupole mass spectrometer having quadrupole mass filters arranged upstream and downstream of a collision cell that dissociates an ion.

In general MS/MS analysis, first, a target ion species having a specific mass-to-charge ratio (mass m/valence z) is sorted out as a precursor ion from among ion species generated from a sample containing a substance to be analyzed, and the sorted-out precursor ion is dissociated through collision induced dissociation (CID) method, electron capture dissociation (ECD) method or the like to generate product ions. This is selection and dissociation operation of an ion species. Then, similarly to normal mass spectrometry, various product ions thus generated are separated and detected according to mass-to-charge ratios. Since an ion species originated from a certain kind of substance causes a characteristic form of dissociation through CID or ECD, for example, detecting a site of occurrence of the dissociation can lead to a conclusion that the substance to be analyzed has a specific chemical structure.

In the aforementioned triple quadrupole mass spectrometer, the selection operation of the precursor ion is performed in a front-stage quadrupole mass filter; in a subsequent collision cell, the dissociation operation of the precursor ion is performed; and in a further subsequent rear-stage quadrupole mass filter, mass separation of the product ions is performed. Typically, the mass-to-charge ratio of the ion selected through the front-stage quadrupole mass filter and the mass-to-charge ratio of the ion selected through the rear-stage quadrupole mass filter can be independently and freely set.

Three well-known scanning measurement techniques in the MS/MS analysis are product ion scanning, precursor ion scanning and neutral loss scanning (for example, see Patent Literature 1). In the product ion scanning, all the product ions that are generated from a specific precursor ion are scanned to create a so-called mass spectrum. In the precursor ion scanning, conversely, all the precursor ions that generate a specific product ion are scanned. Moreover, in the neutral loss scanning, all the precursor ions that a specific partial structure is eliminated are searched for by scanning the mass-to-charge ratios of the ions that can pass through both mass filters such that a difference between the mass-to-charge ratios of the ions passing through the front-stage and rear-stage quadrupole mass filters is constant.

The feature of the latter two techniques is that only the precursor ion having a certain specific product ion or neutral loss is specifically detected. Typically, when a fragment eliminated from the precursor ion through the dissociation operation does not have a charge (is neutral), the neutral loss scanning is used, and when the fragment has a charge, the precursor ion scanning is used.

The neutral loss scanning is an analysis technique that makes it possible to detect an ion pair having a mass-to-charge ratio difference, between the precursor ion and the product ion, that is specific to a structure such as a functional group, and is particularly useful in the case where a protein is class-specifically identified or the similar case. However, in neutral loss scanning in a conventional MS/MS mass spectrometer, it is assumed that the eliminated fragment is neutral. Therefore, in the case where the valence of the product ion is different from the valence of the precursor ion due to, for example, a charged fragment being eliminated by dissociating a multivalent precursor ion through CID, neutral loss scanning cannot be performed. Moreover, in a dissociation through ECD, although the eliminated fragment is neutral, the valence of the product ion differs from the valence of the precursor ion through the dissociation. Therefore, the mass-to-charge ratio difference between the two ions is not constant, and neutral loss scanning cannot be applied either.

Moreover, when a multivalent precursor ion is dissociated through CID and a charged fragment is eliminated, both of the eliminated fragment and the product ion after elimination have charges. This means that not only the product ion but also the eliminated fragment can be detected when the ion originated from the sample is a multivalent ion. In general, in the quadrupole mass filter and a multipole ion guide implemented in the collision cell, the range of mass-to-charge ratios of ions that can stably pass through is limited to a certain extent, and therefore, when the mass-to-charge ratio of the product ion to be detected is too small or too large, such a product ion cannot adequately pass through the collision cell or the rear-stage quadrupole mass filter, which deteriorates detection sensitivity. If the mass-to-charge ratio of an ion generated through dissociation of a multivalent ion can be arbitrarily selected and stably detected, by selectively detecting either one of the product ion generated from the ion originated from a certain component and the eliminated charged fragment, useful information regarding the component can be obtained at high sensitivity. However, an MS/MS mass spectrometer that can perform such analysis on the multivalent ion does not conventionally exist.

Moreover, when a compound containing an element having a characteristic isotope pattern, such as chlorine, is analyzed, if the mass-to-charge ratio of an ion generated through dissociation of a multivalent ion originated from the compound can be arbitrarily selected and detected, information of the position of the element in the compound may be obtained by confirming whether or not the aforementioned isotope pattern exists in the detected ion. However, an MS/MS mass spectrometer that can perform such analysis on the multivalent ion does not conventionally exist.

CITATION LIST

Patent Literature

[Patent Literature 1]WO 2010/089798

SUMMARY OF INVENTION

Technical Problem

The present invention is devised to solve the aforementioned problem and a primary object thereof is to provide an MS/MS mass spectrometric method and an MS/MS mass spectrometer capable of detecting a product ion that cannot be appropriately detected by conventional neutral loss scanning as in the case where an ion originated from a target component is a multivalent ion and a fragment eliminated through CID has a charge, the case where a partial structure having gained a charge through ECD is neutralized and eliminated through electron capture, or the similar case.

Moreover, another object of the present invention is to provide an MS/MS mass spectrometric method and an MS/MS mass spectrometer capable of selectively detecting a product ion or a charged fragment having any mass-to-charge ratio even in the case where a valence of the product ion differs from a valence of a precursor ion, such as the case where the ion originated from the target component is a multivalent ion and a fragment eliminated through CID has a charge, or the case where a neutral fragment is eliminated through ECD.

Solution to Problem

A first invention devised to solve the aforementioned problem is an MS/MS mass spectrometer including an ionizing unit for ionizing a target component in a sample, a first mass separating unit for selecting, as a precursor ion, an ion having a specific mass-to-charge ratio from multivalent ions, the multivalent ion having a valence of two or more out of ions originated from the target component, a dissociation operation unit for dissociating the precursor ion selected by the first mass separating unit, a second mass separating unit for selecting a product ion having a specific mass-to-charge ratio from product ions generated through the dissociation, and a detecting unit for detecting the ion selected by the second mass separating unit, the MS/MS mass spectrometer comprising:

a) a first inputting unit for allowing a user to input and set a mass $m_{Loss}$ of a fragment eliminated from the precursor ion through the dissociation;

b) a second inputting unit for allowing the user to input and set at least two of three parameters of a valence $z_{Loss}$ of the fragment, a valence $z_{Prec}$, of the precursor ion and a valence $z_{Prod}$ of the product ion, the valence $Z_{Loss}$ of the fragment being a valence of the fragment eliminated from the precursor ion through the dissociation when the dissociation is based on dissociation operation other than electron capture dissociation or a valence of a fragment before neutralized that captures an electron to be neutralized and eliminated when the dissociation is based on the electron capture dissociation;

c) a lack information calculating unit for calculating, when one of the three parameters $z_{Loss}$, $z_{Prec}$ and $z^{Prod}$ is not input, the one uninput parameter $z_{Loss}$, $z_{Prec}$ or $z_{Prod}$ from the parameters input by the second inputting unit using relation, $z_{Prec}=z_{Prod}+z_{Loss}$; and d) a controlling unit for individually controlling operations of the first mass separating unit and the second mass separating unit in performing MS/MS analysis such that a mass-to-charge ratio $M_{prod}$ of the product ion selected by the second mass separating unit with respect to a mass-to-charge ratio $M_{Proc}$ of the precursor ion selected by the first mass separating unit satisfies relation, $M_{Prod}=(M_{Proc}\times z_{Prec}-m_{Loss})/z_{Prod}$.

Moreover, a second invention devised to solve the aforementioned problem is an MS/MS mass spectrometer including an ionizing unit for ionizing a target component in a sample, a first mass separating unit for selecting, as a precursor ion, an ion having a specific mass-to-charge ratio from multivalent ions, the multivalent ion having a valence of two or more out of ions originated from the target component, a dissociation operation unit for dissociating the precursor ion selected by the first mass separating unit, a second mass separating unit for selecting a product ion having a specific mass-to-charge ratio from product ions generated through the dissociation, and a detecting unit for detecting the ion selected by the second mass separating unit, the MS/MS mass spectrometer comprising:

a) a first inputting unit for allowing a user to input and set a mass $m_{Loss}$ of a fragment eliminated from the precursor ion through the dissociation;

b) a second inputting unit for allowing the user to input and set any one of two parameters of a valence $z_{Loss}$ of the fragment and a valence $z_{Prod}$ of the product ion, the valence $z_{Loss}$ of the fragment being a valence of the fragment eliminated from the precursor ion through the dissociation when the dissociation is based on dissociation operation other than electron capture dissociation or a valence of a fragment before neutralized that captures an electron to be neutralized and eliminated when the dissociation is based on the electron capture dissociation;

c) a third inputting unit for allowing the user to input and set a selection criterion for selecting a valence of the precursor ion;

d) a valence determining unit for determining a valence of each ion observed on a mass spectrum obtained through MS analysis on the target component;

e) a precursor ion valence deciding unit for deciding a valence $z_{Prec}$ of the precursor ion to be analyzed based on the valence determined by the valence determining unit and the selection criterion set by the third inputting unit;

f) a valence deciding unit for calculating the one parameter $z_{Prod}$ or $z_{Loss}$ uninput by the second inputting unit from the valence $z_{Prec}$ of the precursor ion decided by the precursor ion valence deciding unit and the one parameter $z_{Loss}$ or $z_{Prod}$ input by the second inputting unit using relation, $z_{Prec}=z_{Prod}+z_{Loss}$ ; and g) a controlling unit for individually controlling operations of the first mass separating unit and the second mass separating unit in performing MS/MS analysis such that a mass-to-charge ratio $M_{Prod}$ of the product ion selected by the second mass separating unit with respect to a mass-to-charge ratio $M_{prec}$ of the precursor ion selected by the first mass separating unit satisfies relation, $M_{Prod}=(M_{Prec}\times z_{Prec}-m_{Loss})/z_{Prod}$.

Each of the MS/MS mass spectrometers according to the first invention and the second invention is typically a triple quadrupole mass spectrometer in which the first mass separating unit is a front-stage quadrupole mass filter, the second mass separating unit is a rear-stage quadrupole mass filter, and the dissociation operation unit is a collision cell inside which an ion guide for focusing ions is implemented. In the dissociation operation unit, an ion can be dissociated by any of various known techniques, representatively, such as CID and ECD.

Moreover, a third invention devised to solve the aforementioned problem is a mass spectrometric method using the MS/MS mass spectrometer according to the first invention and is a mass spectrometric method using an MS/MS mass spectrometer including an ionizing unit for ionizing a target component in a sample, a first mass separating unit for selecting, as a precursor ion, an ion having a specific mass-to-charge ratio from multivalent ions, the multivalent ion having a valence of two or more out of ions originated from the target component, a dissociation operation unit for dissociating the precursor ion selected by the first mass separating unit, a second mass separating unit for selecting a product ion having a specific mass-to-charge ratio from product ions generated through the dissociation, a detecting unit for detecting the ion selected by the second mass separating unit, a controlling unit for individually controlling operations of the first mass separating unit and the second mass separating unit for performing MS analysis and MS/MS analysis, and an inputting unit for allowing a user to input parameters needed for performing the MS/MS analysis, the mass spectrometric method comprising:

a) a first inputting step of allowing the user to input, by the inputting unit, a mass $m_{Loss}$ of a fragment eliminated from the precursor ion through dissociation;

b) a second inputting step of allowing the user to input, by the inputting unit, at least two of three parameters of a valence $z_{Loss}$ of the fragment, a valence $z_{Prec}$ of the precursor ion and a valence $z_{Prod}$ of the product ion, the valence $z_{Loss}$ of the fragment being a valence of the fragment eliminated from the precursor ion through the dissociation when the dissociation is based on dissociation operation other than electron capture dissociation or a valence of a fragment before neutralized that captures an electron to be neutralized and eliminated when the dissociation is based on the electron capture dissociation;

c) a lack information calculating step of calculating, when one of the three parameters $z_{Loss}$, $z_{Prec}$ and $z^{Prod}$ is not input, the one uninput parameter $z_{Loss}$, $z_{Prec}$ or $z_{Prod}$ from the parameters input by the inputting unit using relation, $z_{Prec}=z_{Prod}+z_{Loss}$; and d) an MS/MS analysis performing step of individually controlling, by the controlling unit, operations of the first mass separating unit and the second mass separating unit in performing MS/MS analysis such that a mass-to-charge ratio $Mm_{Prod}$ of the product ion selected by the second mass separating unit with respect to a mass-to-charge ratio $M_{Prec}$ of the precursor ion selected by the first mass separating unit satisfies relation, $M_{Prod}=(M_{Prec}\times z_{Prec}-m_{Loss})/z_{Prod}$.

Furthermore, a fourth invention devised to solve the aforementioned problem is a mass spectrometric method using the MS/MS mass spectrometer according to the second invention and is a mass spectrometric method using an MS/MS mass spectrometer including an ionizing unit for ionizing a target component in a sample, a first mass separating unit for selecting, as a precursor ion, an ion having a specific mass-to-charge ratio from multivalent ions, the multivalent ion having a valence of two or more out of ions originated from the target component, a dissociation operation unit for dissociating the precursor ion selected by the first mass separating unit, a second mass separating unit for selecting a product ion having a specific mass-to-charge ratio from product ions generated through the dissociation, a detecting unit for detecting the ion selected by the second mass separating unit, a controlling unit for individually controlling operations of the first mass separating unit and the second mass separating unit for performing MS analysis and MS/MS analysis, and an inputting unit for allowing a user to input parameters needed for performing the MS/MS analysis, the mass spectrometric method comprising:

a) a first inputting step of allowing the user to input, by the inputting unit, a mass $m_{Loss}$ of a fragment eliminated from the precursor ion through dissociation;

b) a second inputting step of allowing the user to input, by the inputting unit, any one of two parameters of a valence $z_{Loss}$ of the fragment and a valence $z_{Prod}$ of the product ion, the valence $z_{Loss}$ of the fragment being a valence of the fragment eliminated from the precursor ion through the dissociation when the dissociation is based on dissociation operation other than electron capture dissociation or a valence of a fragment before neutralized that captures an electron to be neutralized and eliminated when the dissociation is based on the electron capture dissociation;

c) a third inputting step of allowing the user to input, by the inputting unit, a selection criterion for selecting a valence of the precursor ion;

d) a valence determining step of determining a valence of each ion observed on a mass spectrum obtained through MS analysis on the target component;

e) a precursor ion valence deciding step of deciding a valence $z_{Prec}$ of the precursor ion to be analyzed based on the valence determined in the valence determining step and the selection criterion input in the third inputting step;

f) a valence deciding step of calculating the one parameter $z_{Prod}$ or $z_{Loss}$ uninput in the second inputting unit from the valence $z_{Prec}$ of the precursor ion decided in the precursor ion valence deciding step and the one parameter $z_{Loss}$ or $z_{Prod}$ input in the second inputting step using relation $z_{Prec}=z_{Prod}+z_{Loss}$; and g) an MS/MS analysis performing step of controlling, by the controlling unit, operations of the first mass separating unit and the second mass separating unit in performing MS/MS analysis such that a mass-to-charge ratio $M_{Prod}$ of the product ion selected by the second mass separating unit with respect to a mass-to-charge ratio $M_{Prec}$ of the precursor ion selected by the first mass separating unit satisfies relation, $M_{Prod}=(M_{Prec}\times z_{Prec}-m_{Loss})/z_{Prod}$.

In the MS/MS mass spectrometer according to the first invention, at least two of the three parameters of the valence $z_{Loss}$ of the charged fragment, the valence $z_{Prec}$ of the precursor ion and the valence $z_{Prod}$ of the product ion are input by the second inputting unit. Meanwhile, in the MS/MS mass spectrometer according to the second invention, either one of the valence $z_{Loss}$ of the charged fragment and the valence $z_{Prod}$ of the product ion of the aforementioned three parameters is input by the second inputting unit, and the valence $z_{Prec}$ of the precursor ion is automatically decided by the precursor ion valence deciding unit.

Through dissociation operation in which charged particles such as electrons are not externally supplied, such as CID or infrared multi-photon absorption dissociation (IRMPD), the sum total of charges of the ion and the fragment obtained through dissociation of the precursor ion should be maintained to be the same as before the dissociation. Moreover, through dissociation operation in which the charged particles are externally supplied, such as ECD, the sum total of charges of the ion obtained through dissociation of the precursor ion and the fragment immediately before the dissociation should be the same as before the dissociation. Therefore, assuming that the valence of the precursor ion coincides with the total of the valence of the charged fragment eliminated through dissociation operation (charged fragment immediately before neutralized and eliminated through electron capture in the case of dissociation operation through ECD) and the valence of the product ion, the lack information calculating unit in the first invention, and the valence deciding unit in the second invention calculate the uninput and unknown valence.

Since the valence $z_{Loss}$ of the charged fragment, the valence $z_{Prec}$ of the precursor ion and the valence $z_{Prod}$ of the product ion are determined by the aforementioned processing, in both of the first and second inventions, the controlling unit individually controls the operations of the first mass separating unit and the second mass separating unit in performing the MS/MS analysis such that the mass-to-charge ratio $M_{Prod}$ of the product ion selected by the second mass separating unit with respect to the mass-to-charge ratio $M_{Prec}$ of the precursor ion selected by the first mass separating unit satisfies the relation, $M_{Prod}=(M_{Prec}\times z_{Prec}-m_{Loss})/z_{Prod}$. Thereby, the ion having the mass-to-charge ratio $M_{Prec}$ is selected from various ions originated from the target component by the first mass separating unit, and, the ion having the mass-to-Charge ratio $M_{Prod}$ in $M_{Prod}=(M_{Prec}\times z_{Prec}-M_{Loss})/z_{Prod}$ is selected from various product ions generated through dissociation of the selected ion in the dissociation operation unit by the second mass separating unit to be detected. In response to change of the mass-to-charge ratio of the precursor ion, the mass-to-charge ratio of the product ion is interlinkingly changed such that they satisfy the relation, $M_{Prod}=(M_{Prec}\times z_{Prec}-m_{Loss}/z_{Prod}$.

In the MS/MS mass spectrometer according to the second invention, the valence determining unit can be preferably configured to determine the valence based on an interval of peaks corresponding to isotope ions. Specifically, the valence can be determined by obtaining the reciprocal of the interval of the isotope peaks, for example, the valence being one when the interval of the isotope ions peaks of a certain precursor ion on a mass spectrum is approximately 1 Da on a mass spectrum, the valence being two when the interval is approximately 0.5 Da, the valence being three when the interval is approximately 0.33 Da.

Moreover, in the MS/MS mass spectrometer according to the second invention, the selection criterion by the third inputting unit can be for selecting, in a case where a plurality of kinds of valences are determined by the valence determining unit, one of the valences. Namely, multivalent ions, with different valences, originated from the same compound are sometimes generated depending on types of the compounds and types of the ionization methods, and in such a case, the MS/MS analysis can be performed, focusing on the ion with one valence among those.

A specific form of the MS/MS mass spectrometer according to the second invention can take a configuration in which the selection criterion by the third inputting unit is for selecting a plurality of kinds of valences, and when a plurality of valences $z_{Prec}$ of the precursor ion are decided by the precursor ion valence deciding unit, the controlling unit individually controls the operations of the first mass separating unit and the second mass separating unit so as to perform the MS/MS analysis with the valence of the precursor ion being sequentially changed.

According to this configuration, when the plural multivalent ions, with different valences, originated from the same compound are individually dissociated, plural product ions generating the same neutral loss can be obtained.

In this case, when the selection criterion by the third inputting unit is for selecting all the valences not less that any valence of two or more, all of the plural product ions having the same neutral loss can be obtained with respect to all the multivalent ions originated from the same compound.

While in the MS/MS mass spectrometers according to the first invention and the second invention, the first and second inputting units may be for inputting, as numerical values, the mass and the valences, instead of the numerical value inputting, they may take a configuration in which a composition formula and the valence or an ion formula of the fragment eliminated from the precursor ion is input and a calculating unit for calculating the mass and the valence of the fragment based on information input by the inputting units is further included. Moreover, the first and second inputting units may be for selecting a name of the fragment eliminated from the precursor ion from a plurality of preregistered names, and they may take a configuration in which an acquiring unit for acquiring the mass and the valence of the fragment associated with the name selected by the inputting units is further included. Such configurations can improve operability more than in the case of the numerical value inputting.

Advantageous Effects of Invention

According to the MS/MS mass spectrometers according to the first and second inventions and the MS/MS mass spectrometric methods according to the third and fourth inventions, even when the ion generated from the target component to be analyzed is a multivalent ion, similarly to a general neutral loss scanning method, the mass-to-charge ratio of the precursor ion and the mass-to-charge ratio of the product ion can be interlinkingly scanned such that the mass of the fragment eliminated from the precursor ion takes a certain constant value. Thereby, a substance having a specific chemical structure can be easily searched for.

Moreover, according to the MS/MS mass spectrometers according to the first and second inventions and the MS/MS mass spectrometric methods according to the third and fourth inventions, the mass and the valence of a charged fragment eliminated from a multivalent precursor ion can be arbitrarily set by a user. Therefore, it is possible to obtain information about the target component at high sensitivity by setting the operation of the rear-stage quadrupole mass filter such that either one of the product ion generated from the ion originated from the target component and the eliminated charged fragment that can more stably and efficiently pass through the collision cell and the rear-stage quadrupole mass filter is selected.

Furthermore, since the mass-to-charge ratio of the ion generated through dissociation of the multivalent ion originated from a compound containing an element having a characteristic isotope pattern can also be properly selected, by confirming whether or not the isotope pattern exists in the detected ions, information of the position of the element in the compound can be obtained.

DESCRIPTION OF EMBODIMENTS

Figure 1:
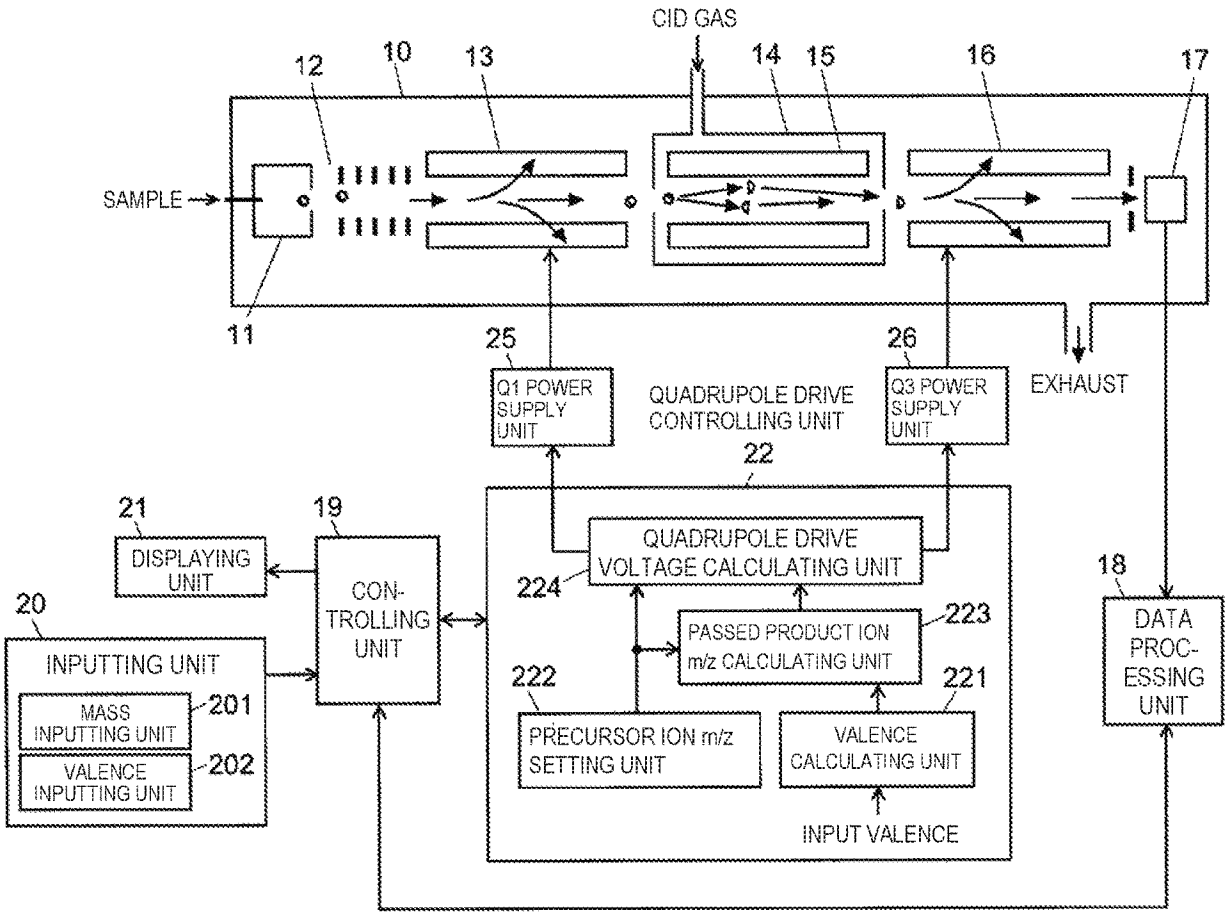
FIG. 1 is a configuration diagram of the essential part of a triple quadrupole mass spectrometer of a first embodiment of the present invention.

An MS/MS mass spectrometer according to the present invention is described, exemplified by a triple quadrupole mass spectrometer FIG. 1 is a configuration diagram of the essential part of a triple quadrupole mass spectrometer of a first embodiment according to the present invention. Inside an analysis chamber 10 evacuated to a vacuum by a vacuum pump not shown, arranged are an ion source 11 that ionizes components in a sample to be analyzed, an ion optical system 12 that transfers ions generated in the ion source 11, a front-stage quadrupole mass filter 13, constituted of four rod electrodes, that selectively causes an ion having a specific mass-to-charge ratio to pass through, a collision cell 14, including a quadrupole ion guide 15 constituted of four rod electrodes inside, that dissociates the ion, a rear-stage quadrupole mass filter 16, constituted of four rod electrodes similarly to the front-stage quadrupole mass filter 13, that selectively causes an ion having a specific mass-to-charge ratio to pass through, and a detector 17 that detects ions to output a detection signal according to the amount of the ions. A Q1 power supply unit 25 applies a voltage having a DC (direct current) voltage and a high frequency voltage combined to the front-stage quadrupole mass filter 13, and a Q3 power supply unit 26 applies a voltage having a DC voltage and a high frequency voltage to the rear-stage quadrupole mass filter 16 Naturally, proper voltages are also applied to other parts such as the quadrupole ion guide 15, but description thereof not relating directly to the present invention is omitted.

The detection signal (ion intensity signal) output from the detector 17 is input into a data processing unit 18 and converted into digital data, and after that, processing of the data, such as mass spectrum creation, is performed. An inputting unit 20 operated by an analyzing operator (user) and a displaying unit 21 are connected to a controlling unit 19 that conducts control of the whole mass spectrometer. A quadrupole drive controlling unit 22 includes, as functional blocks, a valence calculating unit 221, a precursor ion m/z setting unit 222, a passed product ion m/z calculating unit 223 and a quadrupole drive voltage calculating unit 224 and controls the aforementioned Q1 power supply unit 25 and Q3 power supply unit 26. Moreover, the inputting unit 20 is a typical inputting unit such as a keyboard and includes a mass inputting unit 201 and a valence inputting unit 202 as functional blocks.

At least parts of the data processing unit 18, the controlling unit 19 and the quadrupole drive controlling unit 22 may be configured to embody the functions of the parts using a general-purpose personal computer as a hardware resource and by operating dedicated controlling and processing software installed in the computer. Namely, the triple quadrupole mass spectrometer of this embodiment has the same hardware with that in a conventional apparatus, and can be realized by changing software for operating the mass spectrometer and processing data obtained through analysis from conventional one.

An operational overview of the triple quadrupole mass spectrometer of this embodiment in MS/MS analysis is described. In MS/MS analysis, proper CID gas such as argon (Ar) is introduced into the collision cell 14. When a sample containing a target component to be analyzed is introduced into the ion source 11, the target component is ionized in the ion source 11. Generated ions are introduced into the front-stage quadrupole mass filter 13 through the ion optical system 12. The Q1 power supply unit 25 applies the voltage having a DC voltage and a high frequency voltage combined to the front-stage quadrupole mass filter 13, and only an ion having a specific mass-to-charge ratio according to the applied voltage out of the various ions originated from the target component passes through the filter 13 as a precursor ion.

The precursor ion sent into the collision cell 14 collides with the CID gas to be dissociated through CID so that product ions are generated. Various forms of this dissociation typically generate plural kinds of product ions having different mass-to-charge ratios from one kind of precursor ion. These various kinds of product ions travel while focused by the quadrupole ion guide 15, go out of the collision cell 14, and are introduced into the rear-stage quadrupole mass filter 16. The Q3 power supply unit 26 applies the voltage having a DC voltage and a high frequency voltage combined to the rear-stage quadrupole mass filter 16, and only an ion having a specific mass-to-charge ratio according to the applied voltage out of the various kinds of product ions originated from the target component passes through the filter 16 to reach the detector 17. When only monovalent ions are considered as the ions originated from the target component generated in the ion source 11, neutral loss scanning is achieved by scanning the mass-to-charge ratios of the ions passing through the front-stage quadrupole mass filter 13 and the rear-stage quadrupole mass filter 16 such that a difference between the mass-to-charge ratio of the ion that may pass through the front-stage quadrupole mass filter 13 and the mass-to-charge ratio of the ion that may pass through the rear-stage quadrupole mass filter 16 can be maintained to be constant.

In the case where the ion source 11 is, for example, an electrospray ion (ESI) source or the similar case, multivalent ions are likely to be generated depending on a compound (for example, a polymeric compound such as a protein), and in addition, a range of the valences is considerably wide. When generation of multivalent ions is expected as above, or when preliminary analysis (not necessarily limited to analysis using the present apparatus) confirms generation of multivalent ions, in the triple quadrupole mass spectrometer of this embodiment, characteristic MS/MS analysis for multivalent ions as mentioned below can be implemented.

Namely, before MS/MS analysis, the analyzing operator inputs a mass value $m_{Loss}$ of a fragment to be eliminated from the precursor ion in dissociation operation through the mass inputting unit 201. When various ions that a specific chemical structure is eliminated are studied, the mass value of the specific chemical structure only has to be input. This is the same as setting of a neutral loss in a conventional neutral loss scanning method. Moreover, the analyzing operator inputs at least two values of a valence $z_{Loss}$ of the eliminated fragment, a valence $z_{Prec}$ of the precursor ion and a valence $z_{Prod}$ of the product ion through the valence inputting unit 202. Such a procedure of input setting of the valences does not exist in a conventional neutral loss scanning method since the eliminated fragment is regarded as neutral and each of the valences of the precursor ion and the product ion is regarded as one. Moreover, analysis conditions other than those, such as a range of the mass-to-charge ratio of the precursor ion to be scanned in the case of neutral loss scanning (or a range of the mass-to-charge ratio of the product ion to be scanned), are input.

Upon reception of input of the parameters as above, when one of the valence $z_{Prec}$ of the precursor ion and the valence $z_{Prod}$ of the product ion is not input, the valence calculating unit 221 obtains the uninput valence $z_{Prec}$ or $Z_{Prod}$ through calculation based on the relation, $z_{Prec}=z_{Prod}+z_{Loss}$. Accordingly, the two valences $z_{Prec}$ and $z_{Prod}$ are input as parameters into the passed product ion m/z calculating unit 223 even when any one valence of these is not input.

Upon the start of MS/MS analysis, the precursor ion m/z setting unit 222 sets a mass-to-charge ratio $M_{Prec}$ of an ion that passes through the front-stage quadrupole mass filter 13. For example, when the range of the mass-to-charge ratio of the precursor ion to be scanned is designated as mentioned above in the case of neutral loss scanning, the mass-to-charge ratio $M_{Prec}$, of the precursor ion is increased in stages from the lower limit value to the upper limit of the designated range according to the designation. Moreover, when a specific precursor ion is designated, the precursor ion m/z setting unit 222 outputs a predetermined mass-to-charge ratio $M_{Prec}$, according to the designation. Meanwhile, the passed product ion m/z calculating unit 223 obtains a mass-to-charge ratio $M_{Prod}$ of the product ion that passes through the rear-stage quadrupole mass filter 16 with respect to the mass-to-charge ratio $M_{Prec}$, of the precursor ion through calculation by applying the given mass-to-charge ratio $M_{Prec}$ of the precursor ion, mass $m_{Loss}$ of the eliminated fragment, and valences $z_{Prec}$ and $z_{Prod}$ to the relational expression, $M_{Prod}=(M_{Prec}\times z_{Prec}-m_{Loss})/z_{Prod}$. Thereby, the quadrupole drive voltage calculating unit 224 is instructed with the mass-to-charge ratio $M_{Prec}$, of the precursor ion and the mass-to-charge ratio $M_{Prod}$ of the product ion as a pair, and the quadrupole drive voltage calculating unit 224 sends control signals to the Q1 power supply unit 25 and the Q3 power supply unit 26 such that voltages corresponding to these mass-to-charge ratios $M_{Prec}$ and $M_{Prod}$ are generated.

Since the mass $m_{Loss}$ of the eliminated fragment and the valences $z_{Prec}$ and $z_{Prod}$ are constant, with the mass-to-charge ratio $M_{Prod}$ of the product ion being scanned, the mass-to-charge ratio $M_{Prod}$ of the product ion varies accordingly. Thereby, pairs of precursor ions and product ions that result in elimination of a specific charged fragment having the mass $m_{Loss}$ and the valence $z_{Loss}$ can be studied.

Moreover, instead of neutral loss scanning, a specific product ion (or charged fragment) generated through dissociation of a multivalent ion can also be selectively detected. Namely, when a product ion generated from an ion originated from the target component and a charged fragment eliminated can be estimated, the analyzing operator pre-inputs parameters such that one, of those, that can more stably and efficiently pass through the collision cell 14 and the rear-stage quadrupole mass filter 16 can be set to be a detection target and the other can be removed. Thereby, information regarding the target component (for example, the content of the target component) can be obtained at high sensitivity.

In the aforementioned description of the embodiment, numerical values are input through the mass inputting unit 201 and the valence inputting unit 202. Instead, the analyzing operator may select a composition formula of the eliminated fragment and its valence or an ion formula from beforehand prepared many alternatives, and the mass and the valence may be calculated from the composition formula or the ion formula inside the quadrupole drive controlling unit 22. Likewise, in place of the composition formula or the ion formula, the analyzing operator may simply select a name of the eliminated fragment from beforehand prepared many alternatives.

Figure 2:
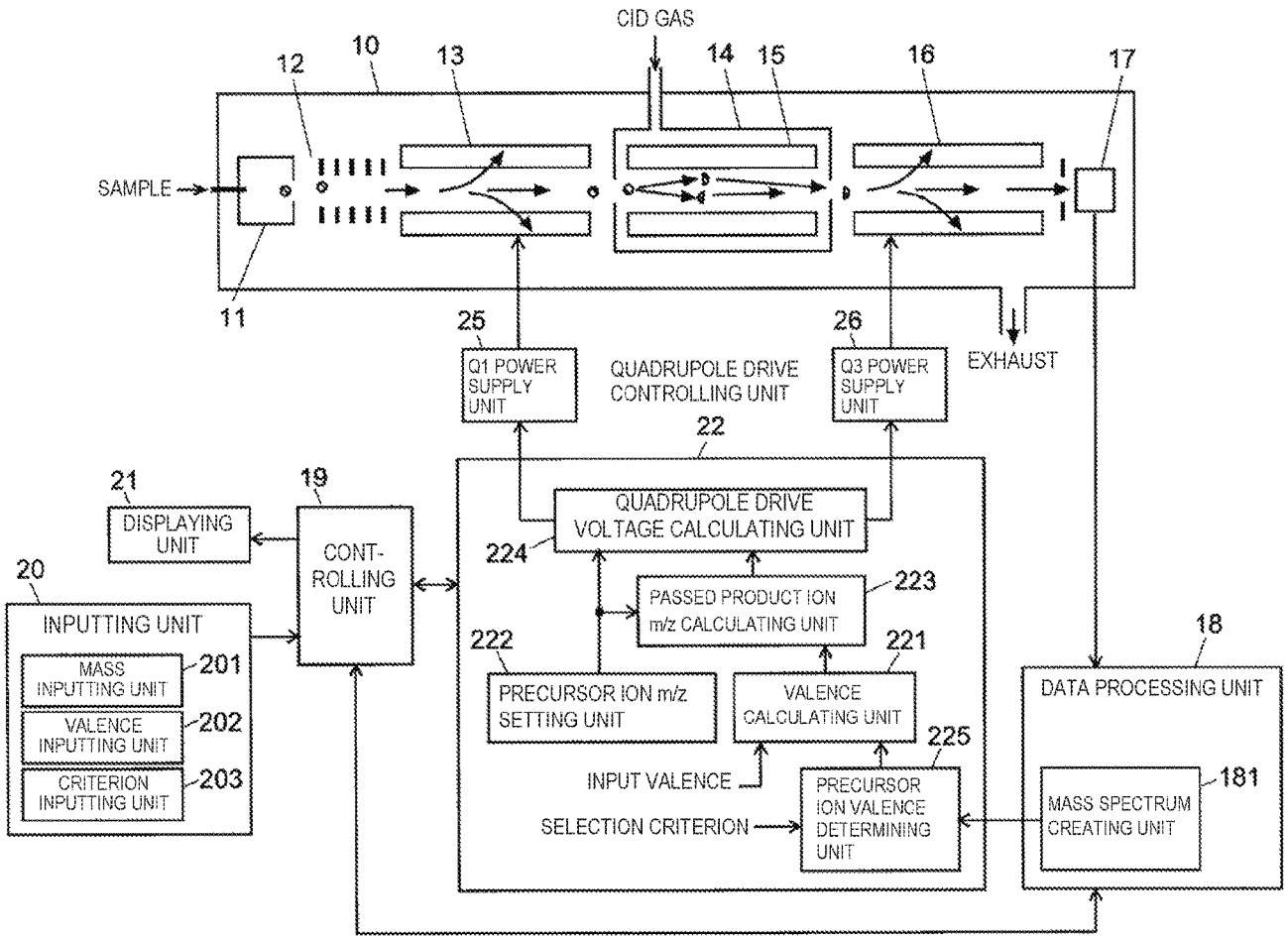
FIG. 2 is a configuration diagram of the essential part of a triple quadrupole mass spectrometer of a second embodiment of the present invention.

FIG. 2 is a configuration diagram of the essential part of a triple quadrupole mass spectrometer of a second embodiment according to the present invention. Configurations identical or corresponding to those of the triple quadrupole mass spectrometer of the first embodiment shown in FIG. 1 are given the same signs. In this triple quadrupole mass spectrometer of the second embodiment, the inputting unit 20 includes, as a functional block, a criterion inputting unit 203 for inputting a selection criterion for selecting a valence of the precursor ion as well as the mass inputting unit 201 and the valence inputting unit 202. Moreover, the quadrupole drive controlling unit 22 includes a precursor ion valence determining unit 225 that determines the valence of the precursor ion based on a mass spectrum created by a mass spectrum creating unit 181 included in the data processing unit 18. A method of determining the valence, and the aforementioned selection criterion are described later in detail.

Procedures and operation in implementing characteristic MS/MS analysis for multivalent ions in the triple quadrupole mass spectrometer of the second embodiment are described.

Before analysis, the analyzing operator inputs the mass value $m_{Loss}$ of the fragment eliminated from the precursor ion in dissociation operation through the mass inputting unit 201. This is the same as in the first embodiment. Furthermore, the analyzing operator inputs one value of the valence $Z_{Loss}$ of the eliminated fragment and the valence $Z_{Prod}$ of the product ion through the valence inputting unit 202, and inputs the selection criterion for selecting the valence of the precursor ion through the criterion inputting unit 203.

When a compound that is likely to become multivalent ions is ionized by an ionization method such as ESI, multivalent ions having various valences are often generated. The aforementioned selection criterion is a condition for deciding a valence of an ion selected as the precursor ion out of various kinds of multivalent ions different in valence. For example, the selection criterion can take any one of the followings.

(1) Any one valence of valences of two or more is set. In this case, a multivalent ion with one valence matching the set selection criterion is selected as the precursor ion.

(2) Any plural valences of valences of two or more are set. In this case, multivalent ions with plural valences matching the set selection criterion are sequentially selected as the precursor ion.

(3) Any valence of valences of two or more is set as the lower limit value of a valence range. In this case, all the multivalent ions having valences not less than the lower limit value set as the selection criterion are sequentially selected as the precursor ion.

(4) The lower limit value and the upper limit value of any valence range of valences of two or more are set. In this case, all the multivalent ions having valences not less than the lower limit value and not more than the upper limit value set as the selection criterion are sequentially selected as the precursor ion.

Moreover, similarly to the first embodiment, the analyzing operator also inputs analysis conditions other than the above, such, for example, as a range of the mass-to-charge ratio of the precursor ion to be scanned (or a range of the mass-to-charge ratio of the product ion to be scanned) in the case of neutral loss scanning.

Upon instruction of the start of analysis, before MS/MS analysis, normal MS analysis for the sample containing the target component is performed. In this stage without CID gas introduced into the collision cell 14, either the front-stage quadrupole mass filter 13 or the rear-stage quadrupole mass filter 16 performs mass scanning within a predetermined mass range, and the mass spectrum creating unit 181 creates a mass spectrum based on data thus collected. When the compound to be analyzed contains an isotope element other than a stable isotope element, plural peaks corresponding to isotope ions that are the same in composition and different in isotope elements, that is, an isotope peak group appears on the mass spectrum. Here, an interval of the isotope peaks included in one isotope peak group depends on the valence of the ion, and the reciprocal of the interval of the isotope peaks indicates the valence, for example, the valence being one when the interval of the peaks is approximately 1 Da, the valence being two when the interval is approximately 0.5 Da, the valence being three when the interval is approximately 0.33 Da. Therefore, the precursor ion valence determining unit 225 automatically determines the valence of the generated multivalent ion based on the interval of the isotope ion peaks appearing on the mass spectrum and originated from the target component.

Then, the precursor ion valence determining unit 225 decides the valence(s) of the multivalent ion(s) to be selected as the precursor ion(s) in accordance with the selection criterion input and set through the criterion inputting unit 203 as mentioned above. The one or plural valences decided here correspond to the valence $z_{Prec}$ of the precursor ion input through the valence inputting unit 202 in the first embodiment. namely, in this second embodiment, the valence $z_{Prec}$ of the precursor ion is decided based on the determination result of the valence of the actually generated multivalent ion and the input selection criterion.

As mentioned above, since one value of the valence $z_{Loss}$ of the eliminated fragment and the valence $z_{Prod}$ of the product ion has been input and the valence $z_{Prec}$, of the precursor ion is decided by the precursor ion valence determining unit 225, the valence calculating unit 221 obtains the uninput valence $z_{Loss}$ or $Z_{Prod}$ through calculation based on the relation, $z_{Prec}=z_{Prod}+z_{Loss}$. Thereby, similarly to the first embodiment, the two valences $z_{Proc}$ and $Z_{Prod}$ are input as parameters into the passed product ion m/z calculating unit 223.

Subsequently, MS/MS analysis is performed. The operation in this MS/MS analysis is the same as in the first embodiment. Namely, the precursor ion m/z setting unit 222 outputs the mass-to-charge ratio $M_{Prec}$ , according to the designation of the analysis conditions, the passed product ion m/z calculating unit 223 obtains the mass-to-charge ratio $M_{Prod}$ of the product ion that passes through the rear-stage quadrupole mass filter 16 with respect to the mass-to-charge ratio $M_{Prec}$, of the precursor ion through calculation by applying the given mass-to-charge ratio $M_{Prec}$ of the precursor ion, mass $m_{Loss}$ of the eliminated fragment, and valences $z_{Prec}$ and $z_{Prod}$ to the relational expression, $M_{Prod}=(M_{Prec}\times z_{Prec}-m_{Loss})/z_{Prod}$. Thereby, the quadrupole drive voltage calculating unit 224 sends the control signals to the Q1 power supply unit 25 and the Q3 power supply unit 26 such that the voltages corresponding to the mass-to-charge ratios $M_{Prec}$ and $M_{Prod}$ of the precursor ion and the product ion are generated. As a result, the target product ion generated through dissociation of the precursor ion with the multivalent ion that is originated from the target component being as the precursor ion reaches the detector 17 to be detected. In the case of plural ions matching the selection criterion among multivalent ions generated from the target component, the MS/MS analysis is to be performed for each of the plural ions being as the precursor ion.

While in the description of the aforementioned first and second embodiments, the precursor ion is dissociated through CID in the collision cell 14, another dissociation technique may be used. In the case where ECD promoting dissociation by casting slow electrons over the ion is used, when the multivalent ion is dissociated, the eliminated fragment captures electron(s) to be neutralized. In other words, the total valences before and after the dissociation are to vary by the quantity of charge(s) of the captured electron(s) (the total valence before dissociation is the valence of the precursor ion, and the total valence after dissociation is the sum of the valence of the product ion and the valence of the eliminated fragment (the valence is 0 when neutral). Accordingly, in the case of using ECD, the valence $z_{Loss}$ of the eliminated fragment in the aforementioned description means the valence of the fragment before neutralized (before capturing electron(s)).

Moreover, as generally known, an ion generated in the ion source 11 takes time to start from the ion source 11 and pass through the front-stage quadrupole mass filter 13, the collision cell 14 and the rear-stage quadrupole mass filter 16. Therefore, although this does not cause any problem when the mass-to-charge ratio $M_{Prec}$ of the precursor ion and the mass-to-charge ratio $M_{Prod}$ of the product ion are constant (at least during the period of ion detections), durations for the ions passing through cannot be sometimes negligible when these mass-to-charge ratios are rapidly scanned. In such a case, in consideration of the durations for the ions passing through, control to scan the mass-to-charge ratio $M_{Prod}$ of the product ion, delayed by a predetermined time, with respect to scanning of the mass-to-charge ratio $M_{Prec}$ of the precursor ion or the similar control is sometimes performed. The present invention is naturally applicable even to the case where such mass scanning a time lag is performed.

Moreover, not only variations of the aforementioned embodiments and the aforementioned description but also proper modifications, corrections and additions within the spirit of the present invention are apparently included in the scope of the appended claims.

REFERENCE SIGNS LIST

10 . . . Analysis Chamber
11 . . . Ion Source
12 . . . Ion Optical System
13 . . . Front-Stage Quadrupole Mass Filter
14 . . . Collision Cell
15 . . . Quadrupole Ion Guide
16 . . . Rear-Stage Quadrupole Vass Filter
17 . . . Detector
18 . . . Data Processing Unit
181 . . . Mass Spectrum Creating Unit
19 . . . Controlling Unit
20 . . . Inputting Unit
201 . . . Mass Inputting Unit
202 . . . Valence Inputting Unit
203 . . . Criterion Inputting Unit
21 . . . Displaying Unit
22 . . . Quadrupole Drive Controlling Unit
221 . . . Valence Calculating Unit
222 . . . Precursor Ion m/z Setting Unit
223 . . . Passed Product Ion truiz Calculating Unit
224 . . . Quadrupole Drive Voltage Calculating Unit
225 . . . Precursor Ion Valence Determining Unit
25 . . . Q1 Power Supply Unit
26 . . . Q3 Power Supply Unit

The invention claimed is:

1. An MS/MS mass spectrometer including an ionizing unit for ionizing a target component in a sample, a first mass separating unit for selecting, as a precursor ion, an ion having a specific mass-to-charge ratio from multivalent ions, the multivalent ion having a valence of two or more out of ions originated from the target component, a dissociation operation unit for dissociating the precursor ion selected by the first mass separating unit, a second mass separating unit for selecting a product ion having a specific mass-to-charge ratio from product ions generated through the dissociation, and a detecting unit for detecting the ion selected by the second mass separating unit, the MS/MS mass spectrometer comprising:

a) a first inputting unit for allowing a user to input and set a mass $m_{Loss}$ of a fragment eliminated from the precursor ion through the dissociation;

b) a second inputting unit for allowing the user to input and set at least two of three parameters of a valence $z_{Loss}$ of the fragment, a valence $z_{Prec}$ of the precursor ion and a valence $z_{prod}$ of the product ion, the valence $z_{Loss}$ of the fragment being a valence of the fragment eliminated from the precursor ion through the dissociation when the dissociation is based on dissociation operation other than electron capture dissociation or a valence of a fragment before neutralized that captures an electron to be neutralized and eliminated when the dissociation is based on the electron capture dissociation;

c) a lack information calculating unit for calculating, when one of the three parameters $z_{Loss}$, $z_{Prec}$ and $z_{Prod}$ is not input, the one uninput parameter $z_{Loss}$, $z_{Prec}$ or $z_{Prod}$ from the parameters input by the second inputting unit using relation, $z_{Prec}=z_{Prod}+z_{Loss}$; and d) a controlling unit for individually controlling operations of the first mass separating unit and the second mass separating unit in performing MS/MS analysis such that a mass-to-charge ratio $M_{Prod}$ of the product ion selected by the second mass separating unit with respect to a mass-to-charge ratio $M_{Prec}$ of the precursor ion selected by the first mass separating unit satisfies relation, $M_{Prod}=(M_{Prec}\times z_{Prec}-m_{Loss})/z_{Prod}$.

2. The MS/MS mass spectrometer according to claims 1, wherein the first and second inputting units are for inputting a composition formula and the valence or an ion formula of the fragment eliminated from the precursor ion, the MS/MS mass spectrometer further comprising:

a calculating unit for calculating the mass and the valence of the fragment based on information input through the inputting units.

3. The MS/MS mass spectrometer according to claims 1, wherein the first and second inputting units are for selecting a name of the fragment eliminated from the precursor ion from a plurality of pre-registered names, the MS/MS mass spectrometer further comprising:

an acquiring unit for acquiring the mass and the valence of the fragment associated with the name selected by the inputting units.

4. An MS/MS mass spectrometer including an ionizing unit for ionizing a target component in a sample, a first mass separating unit for selecting, as a precursor ion, an ion having a specific mass-to-charge ratio from multivalent ions, the multivalent ion having a valence of two or more out of ions originated from the target component, a dissociation operation unit for dissociating the precursor ion selected by the first mass separating unit, a second mass separating unit for selecting a product ion having a specific mass-to-charge ratio from product ions generated through the dissociation, and a detecting unit for detecting the ion selected by the second mass separating unit, the MS/MS mass spectrometer comprising:

a) a first inputting unit for allowing a user to input and set a mass $m_{Loss}$ of a fragment eliminated from the precursor ion through the dissociation;

b) a second inputting unit for allowing the user to input and set any one of two parameters of a valence $z_{Loss}$ of the fragment and a valence $z_{Prod}$ of the product ion, the valence $z_{Loss}$ of the fragment being a valence of the fragment eliminated from the precursor ion through the dissociation when the dissociation is based on dissociation operation other than electron capture dissociation or a valence of a fragment before neutralized that captures an electron to be neutralized and eliminated when the dissociation is based on the electron capture dissociation;

c) a third inputting unit for allowing the user to input and set a selection criterion for selecting a valence of the precursor ion;

d) a valence determining unit for determining a valence of each ion observed on a mass spectrum obtained through MS analysis on the target component;

e) a precursor ion valence deciding unit for deciding a valence $z_{Prec}$ of the precursor ion to be analyzed based on the valence determined by the valence determining unit and the selection criterion set by the third inputting unit;

f) a valence deciding unit for calculating the one parameter $z_{Prod}$ or $z_{Loss}$ uninput by the second inputting unit from the valence $z_{Prec}$ of the precursor ion decided by the precursor ion valence deciding unit and the one parameter $z_{Loss}$ or $z_{Prod}$ input by the second inputting unit using relation, $z_{Prec}=z_{Prod}+z_{Loss}$; and g) a controlling unit for individually controlling operations of the first mass separating unit and the second mass separating unit in performing MS/MS analysis such that a mass-to-charge ratio $M_{Prod}$ of the product ion selected by the second mass separating unit with respect to a mass-to-charge ratio $M_{Prec}$ of the precursor ion selected by the first mass separating unit satisfies relation, $M_{Prod}=(M_{Prec}\times z_{Prec}-m_{Loss})/z_{Prod}$.

5. The MS/MS mass spectrometer according to claim 4, wherein the valence determining unit determines the valence based on an interval of peaks corresponding to isotope ions.

6. The MS/MS mass spectrometer according to claim 5, wherein the selection criterion by the third inputting unit is for selecting, in a case where a plurality of kinds of valences are determined by the valence determining unit, one of the valences.

7. The MS/MS mass spectrometer according to claim 5, wherein the selection criterion by the third inputting unit is for selecting a plurality of kinds of valences, and when a plurality of valences $z_{prec}$ of the precursor ion are decided by the precursor ion valence deciding unit, the controlling unit individually controls the operations of the first mass separating unit and the second mass separating unit so as to perform the MS/MS analysis with the valence of the precursor ion being sequentially changed.

8. The MS/MS mass spectrometer according to claim 7, wherein the selection criterion by the third inputting unit is for selecting all the valences not less than any valence of two or more.

9. The MS/MS mass spectrometer according to claim 4, wherein the selection criterion by the third inputting unit is for selecting, in a case where a plurality of kinds of valences are determined by the valence determining unit, one of the valences.

10. The MS/MS mass spectrometer according to claim 4, wherein the selection criterion by the third inputting unit is for selecting a plurality of kinds of valences, and when a plurality of valences $z_{Prec}$ of the precursor ion are decided by the precursor ion valence deciding unit, the controlling unit individually controls the operations of the first mass separating unit and the second mass separating unit so as to perform the MS/MS analysis with the valence of the precursor ion being sequentially changed.

11. The MS/MS mass spectrometer according to claim 10, wherein the selection criterion by the third inputting unit is for selecting all the valences not less than any valence of two or more.

12. The MS/MS mass spectrometer according to claim 4, wherein the first and second inputting units are for inputting a composition formula and the valence or an ion formula of the fragment eliminated from the precursor ion, the MS/MS mass spectrometer further comprising:

a calculating unit for calculating the mass and the valence of the fragment based on information input through the inputting units.

13. The MS/MS mass spectrometer according to claim 4, wherein the first and second inputting units are for selecting a name of the fragment eliminated from the precursor ion from a plurality of pre-registered names, the MS/MS mass spectrometer further comprising:

an acquiring unit for acquiring the mass and the valence of the fragment associated with the name selected by the inputting units.

14. An analyzing method using an MS/MS mass spectrometer including an ionizing unit for ionizing a target component in a sample, a first mass separating unit for selecting, as a precursor ion, an ion having a specific mass-to-charge ratio from multivalent ions, the multivalent ion having a valence of two or more out of ions originated from the target component, a dissociation operation unit for dissociating the precursor ion selected by the first mass separating unit, a second mass separating unit for selecting a product ion having a specific mass-to-charge ratio from product ions generated through the dissociation, a detecting unit for detecting the ion selected by the second mass separating unit, a controlling unit for individually controlling operations of the first mass separating unit and the second mass separating unit for performing MS analysis and MS/MS analysis, and an inputting unit for allowing a user to input parameters needed for performing the MS/MS analysis, the analyzing method comprising:

a) a first inputting step of allowing the user to input, by the inputting unit, a mass $m_{Loss}$ of a fragment eliminated from the precursor ion through dissociation;

b) a second inputting step of allowing the user to input, by the inputting unit, at least two of three parameters of a valence $z_{Loss}$ of the fragment, a valence $z_{Prec}$ of the precursor ion and a valence $z_{Prod}$ of the product ion, the valence $z_{Loss}$ of the fragment being a valence of the fragment eliminated from the precursor ion through the dissociation when the dissociation is based on dissociation operation other than electron capture dissociation or a valence of a fragment before neutralized that captures an electron to be neutralized and eliminated when the dissociation is based on the electron capture dissociation;

c) a lack information calculating step of calculating, when one of the three parameters $z_{Loss}$, $z_{Prec}$ and $z_{Prod}$ is not input, the one uninput parameter $z_{Loss}$, $z_{Prec}$ , or $z_{Prod}$ from the parameters input by the inputting unit using relation, $z_{Prec}=z_{Prod}+z_{Loss}$; and d) an MS/MS analysis performing step of individually controlling, by the controlling unit, operations of the first mass separating unit and the second mass separating unit in performing MS/MS analysis such that a mass-to-charge ratio $M_{Prod}$ of the product ion selected by the second mass separating unit with respect to a mass-to-charge ratio $M_{Prec}$ of the precursor ion selected by the first mass separating unit satisfies relation, $M_{Prod}=(M_{Prec}\times z_{Prec}-m_{Loss})/z_{Prod}$.

15. An analyzing method using an MS/MS mass spectrometer including an ionizing unit for ionizing a target component in a sample, a first mass separating unit for selecting, as a precursor ion, an ion having a specific mass-to-charge ratio from multivalent ions, the multivalent ion having a valence of two or more out of ions originated from the target component, a dissociation operation unit for dissociating the precursor ion selected by the first mass separating unit, a second mass separating unit for selecting a product ion having a specific mass-to-charge ratio from product ions generated through the dissociation, a detecting unit for detecting the ion selected by the second mass separating unit, a controlling unit for individually controlling operations of the first mass separating unit and the second mass separating unit for performing MS analysis and MS/MS analysis, and an inputting unit for allowing a user to input parameters needed for performing the MS/MS analysis, the analyzing method comprising:

a) a first inputting step of allowing the user to input, by the inputting unit, a mass $m_{Loss}$ of a fragment eliminated from the precursor ion through dissociation;

b) a second inputting step of allowing the user to input, by the inputting unit, any one of two parameters of a valence $z_{Loss}$ of the fragment and a valence $z_{prod}$ of the product ion, the valence $z_{Loss}$ of the fragment being a valence of the fragment eliminated from the precursor ion through the dissociation when the dissociation is based on dissociation operation other than electron capture dissociation or a valence of a fragment before neutralized that captures an electron to be neutralized and eliminated when the dissociation is based on the electron capture dissociation;

c) a third inputting step of allowing the user to input, by the inputting unit, a selection criterion for selecting a valence of the precursor ion;

d) a valence determining step of determining a valence of each ion observed on a mass spectrum obtained through MS analysis on the target component;

e) a precursor ion valence deciding step of deciding a valence $z_{Prec}$ of the precursor ion to be analyzed based on the valence determined in the valence determining step and the selection criterion input in the third inputting step;

f) a valence deciding step of calculating the one parameter $z_{Prod}$or $z_{Loss}$ uninput in the second inputting unit from the valence $z_{Prec}$ of the precursor ion, decided in the precursor ion valence deciding step and the one parameter $z_{Loss}$ or $z_{Prod}$ input in the second inputting step using relation, $z_{Prec}=z_{Prod}+z_{Loss}$; and g) an MS/MS analysis performing step of controlling, by the controlling unit, operations of the first mass separating unit and the second mass separating unit in performing MS/MS analysis such that a mass-to-charge ratio $M_{Prod}$ of the product ion selected by the second mass separating unit with respect to a mass-to-charge ratio $M_{Prec}$ of the precursor ion selected by the first mass separating unit satisfies relation, $M_{Prod}=(M_{Prec}\times z_{Prec}\times m_{Loss})/z_{Prod}$.

* * * * *